United States Patent [19]

Wardlaw

[11] 4,130,156

[45] Dec. 19, 1978

[54] TIME DELAY FIRE CLOSURE RELEASING DEVICE

[75] Inventor: Russell Wardlaw, San Rafael, Calif.

[73] Assignee: The Cookson Company, San Francisco, Calif.

[21] Appl. No.: 890,534

[22] Filed: Mar. 27, 1978

[51] Int. Cl.[2] ..... E05F 15/20

[52] U.S. Cl. ..... 160/9

[58] Field of Search ..... 160/7–9; 251/49, 69; 335/61, 240

[56] References Cited

U.S. PATENT DOCUMENTS

| | | | |
|---|---|---|---|
| 751,571 | 2/1904 | Stuart et al. | 335/61 |
| 1,230,063 | 6/1917 | Burnham | 335/61 |
| 1,487,439 | 3/1924 | Burnham | 335/61 |
| 1,559,018 | 10/1925 | Taylor | 251/69 |
| 1,708,377 | 4/1929 | Cornell | 160/9 |
| 2,564,208 | 8/1951 | Michelman | 160/9 |
| 2,785,347 | 3/1957 | Tremblay et al. | 335/240 |
| 3,007,342 | 11/1961 | Wardlaw | 160/9 |
| 3,254,660 | 6/1966 | Ray | 335/240 |
| 3,508,446 | 4/1970 | Yeo et al. | 251/69 |

*Primary Examiner*—Peter M. Caun

*Attorney, Agent, or Firm*—Flehr, Hohbach, Test, Albritton & Herbert

[57] ABSTRACT

A time delayed releasing device serves to hold fire closures from being actuated during periodic testing and momentary power failure while still permitting the closure to respond to power outage of more than a momentary nature or to the presence of heat.

11 Claims, 6 Drawing Figures

FIG-4
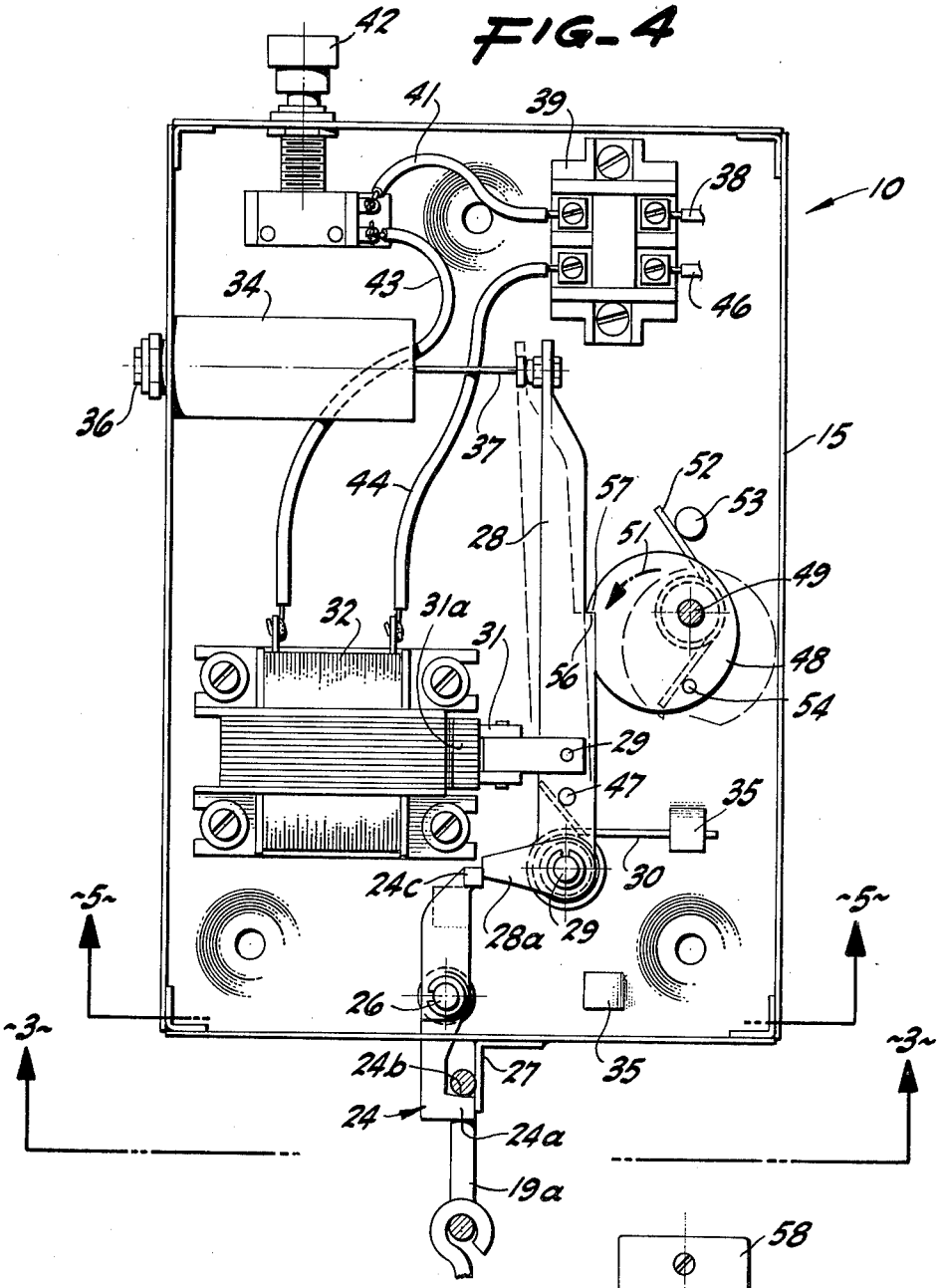
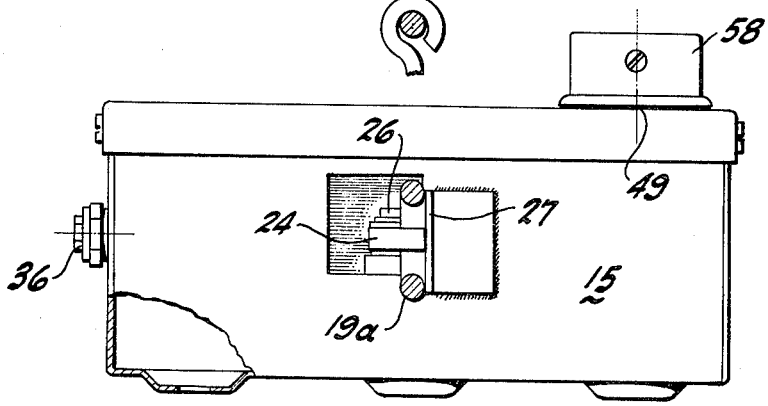
FIG-3

TIME DELAY FIRE CLOSURE RELEASING DEVICE

BACKGROUND OF THE INVENTION

This invention pertains to fire closures and particularly to a fire closure system in which actuation of the closure is delayed for a preset time, measured in seconds, while the alarm system is tested or emergency generating power is brought into play, at which time the system resets itself.

Fire closures, such as fire doors, shutters, dampers, roof hatches and other devices used for fire protection of a building are activated by fusible links and/or electrical devices such as smoke detectors or fire alarm systems which are normally connected to the building's electrical systems usually served by commercial power supply sources. Electrical service is subject from time to time to failure from disability in the power network, electrical storms, high winds, falling trees and other causes. Further, from time to time fire alarm systems in the buildings are activated to insure that they are in proper working order as required by the codes and ordinances of governmental regulating agencies involved. In many systems, each time there is an electrical failure, or the system is tested, all of the fire closure devices mentioned above are activated. Consequently after the test or power outage, they must be reset to place the system back into its "stand-by" mode. This requires that maintenance personnel for the building restore all of the fire closures and the related operators to their "stand-by" condition.

This can entail a substantial number of man hours for buildings such as schools and hospitals which may have on the order of 20 to 40 fire closures. Clearly there is a substantial cost for testing each such alarm system and the switchover from commercial electrical service to an emergency power source.

Accordingly, it is a general object of this invention to provide an improved fire closure system having a mechanism to delay for an adjustable period of time, measured in seconds, the activation of the system serving to affect the fire closure while the alarm system is tested or while emergency generating power is brought into operation and which mechanism will reset itself if the alarm event or power switching event is completed within the delay period.

Another object of the invention is to provide a fail-safe release mechanism energized by electricity and responsive to fire alarm, smoke detection and other detection systems in which the release of the mechanism is delayed for an adjustable period of time measured in seconds.

SUMMARY OF THE INVENTION

In general, there is provided a delayed release mechanism energized by electricity and responsive to fire alarm systems for disengaging a control tension member after a pre-determined period of time. The mechanism includes retaining means suitably supported to move between advanced and retracted positions to release a portion of the tension member. A locking dog member disposed to move between first and second positions serves to unlock and lock the retaining means to preclude releasing movement thereof. The spring means yieldably urges the retaining means towards its release position to cause the retaining means to disengage that portion of the tension member which is otherwise retained by the mechanism when energized. Thus, the electric means serves, when energized, to hold the retaining member in its retracted position against the urging of the spring means. Means for delaying the movement of the locking dog member towards its release positions serves to delay release of the tension member by preventing the retaining member from moving from its locked position.

The above and other objects of the invention will become more readily evident from the following detailed description of the preferred embodiment when considered in connection with the drawings.

BRIEF DESCRIPTION OF THE DRAWINGS

FIG. 3 shows an end elevation view, partially broken away for clarity, along the line of 3—3 of FIG. 4;

FIG. 4 shows a plan view of a delayed release mechanism in its locked condition with respect to releasing a tension member and before being energized;

DETAILED DESCRIPTION OF PREFERRED EMBODIMENT

Figures 1, 2:
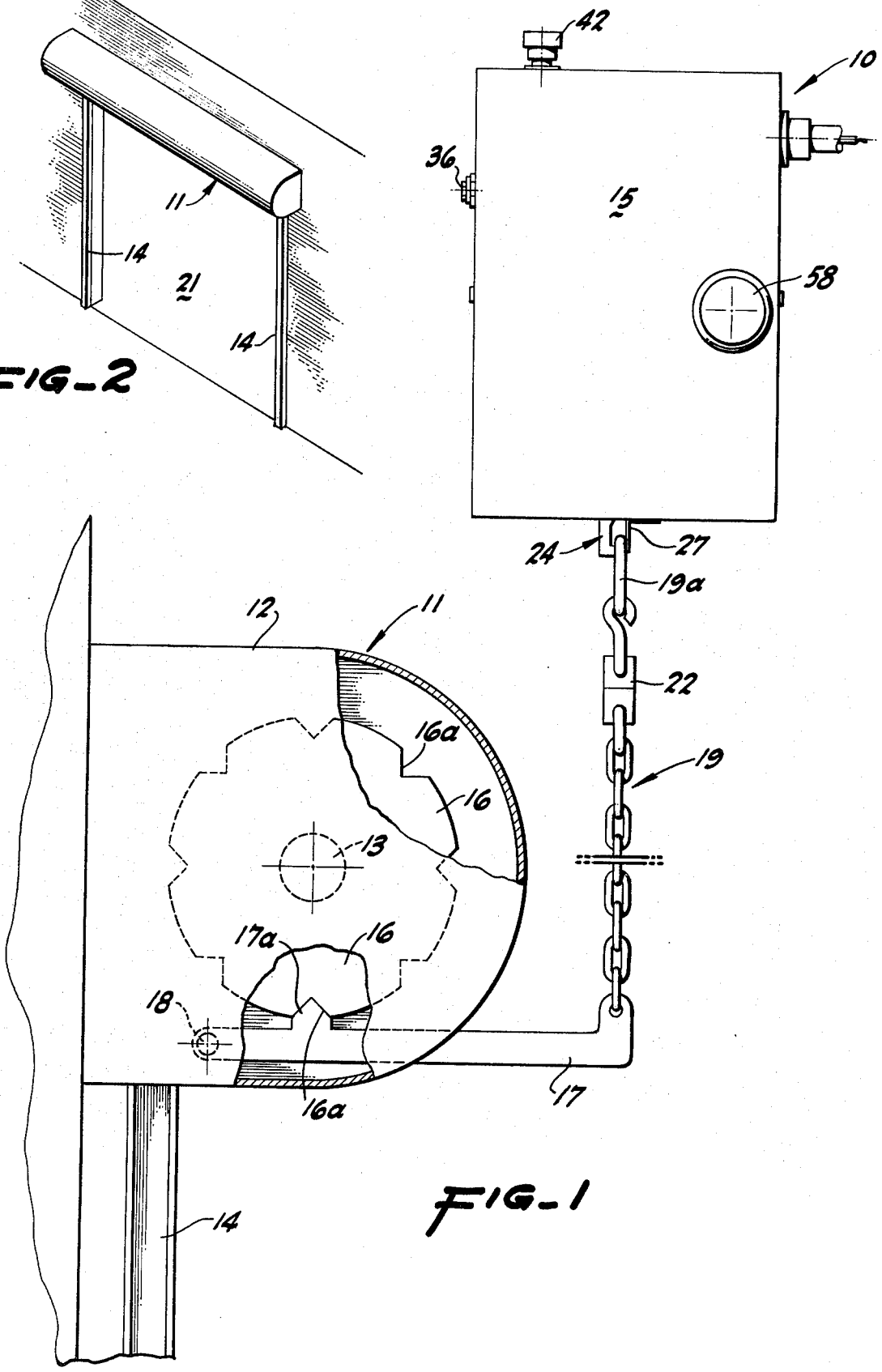
FIG. 1 shows a diagrammatic side elevation view, partially broken away for clarity, of a delayed release rolling door assembly, according to the invention.
FIG. 2 shows a diagrammatic perspective view of a rolling door assembly in its installed position above a doorway.
Figure 6:
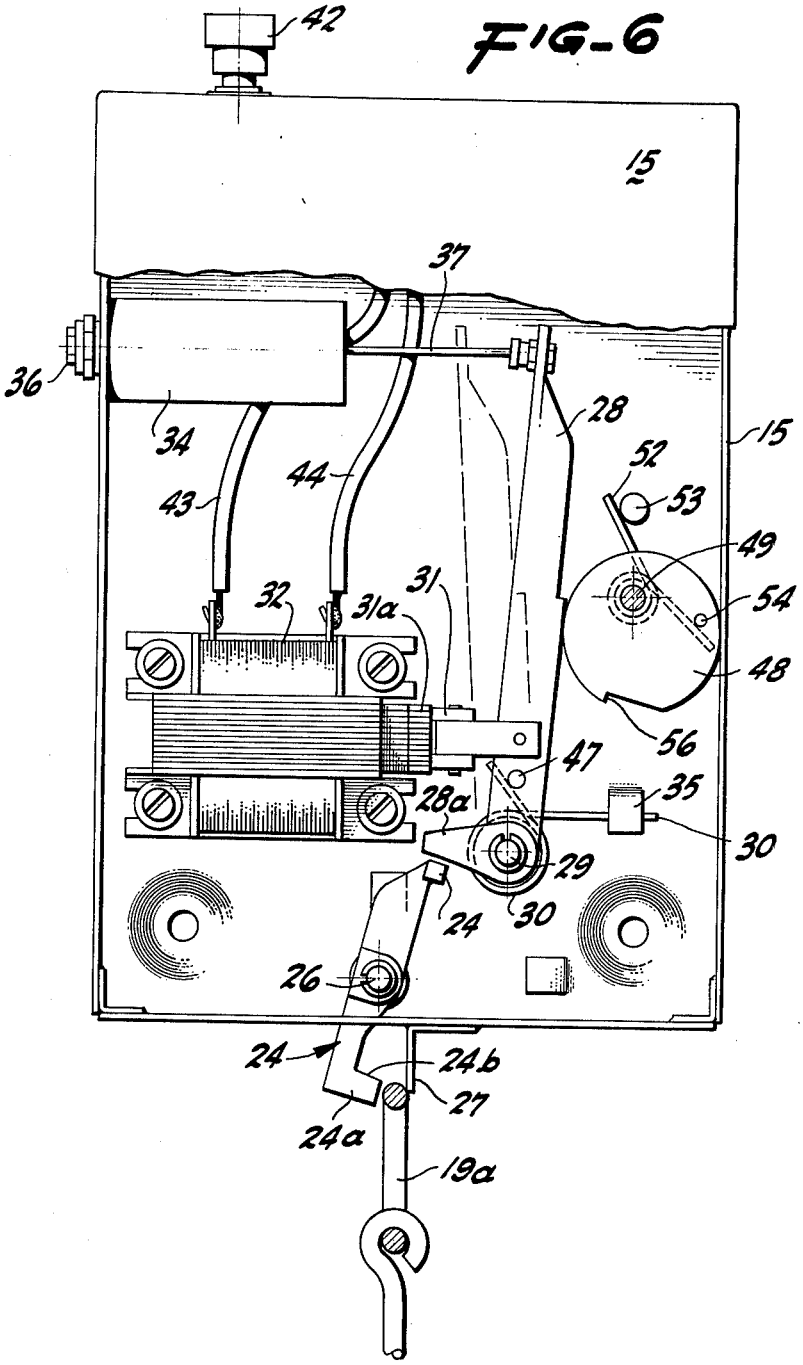
FIG. 6 shows a top plan view (with cover removed) of a delayed release mechanism comparable to FIG. 4 but shown in its de-energized unlocked condition releasing a supporting tension member.
Figure 5:
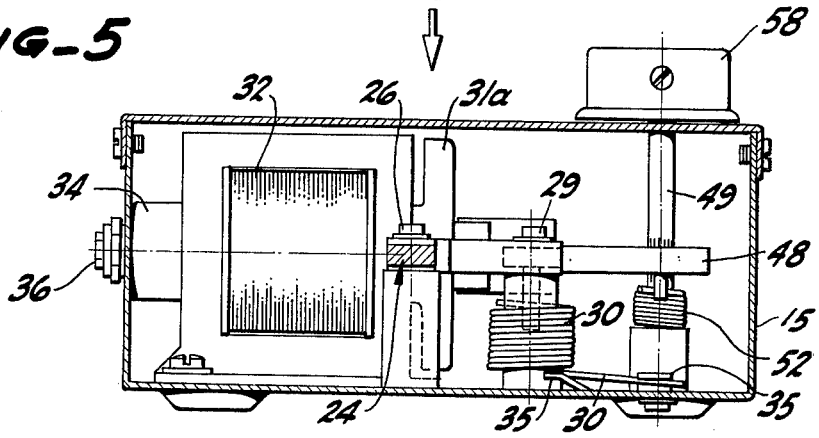
FIG. 5 shows an end elevation section view taken along the line 5—5 of FIG. 4.

In general a delayed release mechanism of the type shown in FIG. 1 and as disclosed herein is shown in association with a rolling door construction or assembly 11 whereby in an emergency condition a predetermined power outage must exist before the door will be released to close the doorway 21.

The rolling door construction 11 is described here as an example of a fire closure in the group which includes fire doors, shutters, dampers, roof hatches and the like. These units are installed in accordance with the recommendations contained in the National Fire Protection Association Standards for Fire Doors and Windows, and is available at the association's headquarters, 470 Atlantic Ave., Bost., Mass. 02210.

Fire doors and the like must be in a fully closed position to perform their intended function or urged toward that position by various means including spring hinges and suspended weights. On the other hand roof hatches and automatic fire vents must be in a fully open position to perform their intended function in a fire protection system and are normally maintained in a closed condition by means such as a latch. When the latch or the like is released spring hinges, counterbalances or a suspended weight causes the hatch to open.

It should be understood that the above listed fire closures are incorporated in a system including automatic fire detectors which when actuated will cause the fire doors and the like to close and the roof hatches and the like to open. Testing provisions are included in the system so that operativeness may be checked periodically.

Accordingly, the present invention may be used with all of the above fire closures as well as with the rolling door assembly 11.

Rolling door assemblies such as 11 are known to include a housing 12, an axle 13, door guides 14 which serve to direct the edges of a rolling door in its movement between raised and lowered positions. Means for holding the door in its raised position rolled about axle 13 includes a detent wheel 16 formed to include a series of detents 16*a* in periphery thereof disposed to move cyclically with downward movement of the door.

A trip arm 17 formed to include a dog portion 17*a* disposed to move into and out of engagement with detents 16*a* serves to arrest movement of the door by arresting rotation of axle 13. Thus, trip arm 17 pivots at 18 to drop downwardly out of engagement with detents 16*a* when the supporting cable 19 (in the form of a chain) is released.

As noted above, door assembly 11 is of a type adapted to be rolled and unrolled with an axle for opening and closing a passage such as the passageway 21. The door in this type of assembly is loaded (by gravity or otherwise) to fall into closing relation with regard to passage 21 when not positively held in its rolled condition. Thus, upon release of the upper end of tension member 19 trip arm 17 will disengage from detent wheel 16 permitting the door to lower itself into closing relation with regard to passageway 21.

As shown in FIG. 1, tension member 19 includes a fusible link 22 whereby upon being sufficiently heated, as by fire within the building, link 22 will separate to release trip-arm 17, and the rolling door. Otherwise, tension member 19 is held in a supporting position by retaining means movable to capture (or release the top link 19*a* of tension member 19.

As shown in FIG. 4 retaining means 23 comprises a clawlike element 24 having a tension member supporting portion 24*a* thereof disposed to move between advanced and retracted positions about the pivot point 26 with respect to a stop member 27. Stop member 27, disposed in confronting relation with respect to claw 24 serves to retain tension member 19 with claw 24 in its advanced position. The top surface 24*b* of tension member supporting portion 24*a* is inclined downwardly toward stop member 27 so as to direct link 19*a* toward stop member 27 to cause the weight of the tension member 19 to move claw portion 24 away from stop member 27 to release the tension member 19. From the foregoing it will be readily evident that as claw 24 pivots about point 26 link 19*a* can either be captured between stop member 27 and claw 24 or released.

However, as now to be described, a locking member is movable between first and second positions so as to unlock and lock the retaining means (claw 24, etc.) respectively in the claw's movement releasing or capturing tension member 19. Thus an elongate locking dog member 28 includes a transversely extending portion 28*a* for engaging a raised portion 24*c* of claw 24 to prevent claw 24 from pivoting about pivot point 26 when so engaged. Locking dog member 28 pivots about a mounting pin 29. Means yieldingly urging member 28 clockwise as shown in FIG. 4 for causing portion 28*a* to be disengaged and thereby release claw 24 comprises the spring 30.

Electric means serve, when energized, to hold dog member 28 in its retracted position against the urging of spring 30 and comprises the solenoid assembly 32 formed with an armature 31 pinned to dog member 28 so that as solenoid 32 is energized dog member 28 will be maintained in its most leftward position shown in phantom in FIG. 4 thereby maintaining portion 28*a* thereof in position to lock the upper end of claw 24. However, upon power failure solenoid 32 will be deenergized and spring 30 will, at that time urge locking drop member 28 clockwise about mounting pin 29 until the right hand side of member 28 engages the eccentrically disposed reset cam 48, whose function is described further below.

Means for delaying clockwise movement of locking member 28 toward its released position serves to sufficiently delay release of tension member 19 so that a magnetic portion 31a of armature 31 will remain sufficiently close to solenoid 32 as to permit it to be "drawn in" and thereby retain dog member 28 and portion 28*a* in a locking position relative to retaining means 23.

Accordingly, a dash pot 34 provided with a vent selectively adjustable by positioning of the screw 36 adjusts the rate of movement to the right of dog member 28 in response to power failure at solenoid 32.

Thus, a piston rod 37 interconnects the distal end of member 28 with a piston (not shown) within dash pot 34.

Means locally associated with the release mechanism serves to selectively deactivate the solenoid 32 for testing the delayed release mechanism as now to be described together with means for resetting the locking dog member 28 after such a test or otherwise.

Accordingly, as shown in FIG. 4 solenoid 32 is activated by means of a circuit traced from a power supply lead 38 via a connecting terminal 39 to a lead 41 on the input side of a test switch 42 which can be manually operated from the exterior of the container or mounting box 15. The output side of switch 42 appears on lead 43 and is traced directly to solenoid 32. The other side of the coil of solenoid 32 is coupled via lead 44 to connecting terminal 39 and to a second power supply lead 46. As thus arranged by depressing the button of switch 42 the circuit to solenoid 32 is momentarily interrupted to simulate a power failure whereby spring 30 acts against a perpendicular pin 47 carried by member 28 to cause member 28 to move clockwise and to move armature portion 31*a* away from the force of the field from the coil of solenoid 32.

Cam means have been provided to reset member 28 to a position sufficiently close to the field of coil 32 so that portion 31*a* and armature 31 will be "drawn in" in response to energizing coil 32. The reset means comprises the eccentrically disposed cam 48 mounted to rotate about the axle 49 as cam 48 is yieldingly urged in the direction of arrow 51 by means of the spring 52 anchored at one end against the fixed post 53 and at the other end engaging a perpendicular pin 54 carried by cam 48. Cam 48 further includes a notch or detent 56 for engaging a comparable notch or detent 57 formed on the back side of member 28.

After experiencing a power failure of sufficient duration to release tension member 19, it becomes necessary to re-open all of the doors which have closed. So that one man can accomplish this, as each door is raised, the release mechanism 10 is reset by first placing ring No. 19*a* within the hooking portion of the claw 24 which is shifted against stop member 27 and then rotating knob 58 until the detent 56 of cam 48 has engaged detent 57. At this point cam 48 will have moved member 28 sufficiently close to the magnetic field of coil 32 so that when the coil is energized member 28 will be moved out of engagement with cam 48 and the spring 52 will drive cam 48 in the direction of arrow 51. This final reset movement of member 28 serves to fully position the blocking end of 28a into the path of element 24c.

Accordingly, it is readily evident that so long as power is continuously supplied to solenoid 32 dog member 28 will remain to the left (as shown in FIG. 4 in phantom lines) with portion 28a in a locking position with respect to the retaining means defined by claw 24 and stop member 27.

From the foregoing it will be readily evident that there has been provided an improved means for delaying the release of fire closures in response to a system test or power failure so as to introduce a sufficient delay for a brief test and to permit auxiliary power to be activated before activating the fire closure

I claim:

1. A delayed release mechanism responsive to power interruption for disengaging a tension member after a predetermined period of power outage comprising retaining means supported to move between advanced and retracted positions to capture and release a portion of the tension means, a locking dog member disposed to move between retracted and released positions to lock and unlock the first named means against movement releasing the tension member, means yieldingly urging said dog member toward its said released positions to release said portion of the tension member, electric means serving when energized, to hold said dog member in its said retracted position against the urging of the last named means, and means for delaying movement of said locking dog member toward its released position to delay release of the tension member.

2. A delayed release mechanism according to claim 1, in which the last named means serves to apply a restraint to inhibit movement of said locking dog member when said dog member is released by de-energizing said electric means.

3. A delayed release mechanism according to claim 1 in which the last named means comprises a dash-pot and means interconnecting a moving portion of said dash-pot to apply a delaying restraint to movement of said locking dog member.

4. A delayed release mechanism according to claim 1 in which the last named means includes means for selectively adjusting the degree of delay to be applied to the movement of the dog member.

5. A delayed release mechanism according to claim 1 including cam means disposed to be rotated for engaging and returning said dog member to a position adjacent said retracted position to relock said dog member.

6. A delayed release mechanism according to claim 5 further including a detent formed in said dog member, the shape of said cam means having a portion formed to engage said detent and hold said dog member in sufficiently closely spaced relation to said electric means so as to be drawn in in response to energizing said electric means and disengaging said detent and cam in response to being so drawn in, and means yieldingly urging said cam means to a position withdrawn from said dog member to provide space for said dog member to move sufficiently away from said coil to a position disposed sufficiently beyond the effective force of said electric means so that re-energizing said electric means will not draw in said dog member.

7. A delayed release mechanism according to claim 1 comprising means locally associated with said release mechanism for selectively deactivating said electric means for testing said delayed release mechanism.

8. In a release mechanism according to claim 1 in which the first named said means comprises a claw portion having a tension member supporting portion thereof disposed to move between advanced and retracted positions, a stop member disposed in confronting relation in respect to said claw for retaining said tension member when the claw is moved to its advanced position, the top surface of said tension member supporting portion being inclined downwardly toward stop member to direct said link carried thereon to move toward said stop member to cause the weight of said tension member to move said claw portion away from said stop member to release the tension member therefrom.

9. In combination a rolling door of a type adapted to be rolled and unrolled with an axle for opening and closing a passage, said door being in a door operating system loaded to move into closing relation when not positively held in its rolled position, electric means for retaining said door in its rolled position notwithstanding momentary power failure comprising means having a series of detents disposed to move cyclically with downward movement of the door, a trip means including a dog portion disposed to move into and out of engagement with said detents to arrest movement of the door, a tension member coupled to said trip means to move therewith between raised and lowered positions, and a delayed release mechanism coupled to said tension member for holding same in a raised position in response to a continuous power supply and for releasing said tension member in response to a power failure in excess of a predetermined period, said mechanism comprising means pivotally supported to move between retracted and released positions to lock and unlock the last named means against movement releasing the tension member, means yieldingly urging said dog member toward its said released position to release said portion of the tension member, electric means serving, when energized, to hold said dog member in its said retracted position against the urging of the last named means, and means for delaying movement of said locking dog member toward its released position to delay release of the tension member.

10. In the combination according to claim 9, wherein said tension member includes a fusible portion destructable in response to fire adjacent thereto so as to rupture and release said trip means from said detents.

11. In a delayed release mechanism responsive to power interruption for disengaging a tension member after a predetermined period of power outage comprising retaining means supported to move between advanced and retracted position to capture and release a portion of the tension member, locking means movable between retracted and advanced positions for holding and releasing the tension member retaining means, electric means for holding said locking means in position serving to block releasing movement of said retaining means, and means coupled to apply a drag to delay movement of said locking means to its said advanced position in response to an interruption of power at said electric means so as to maintain said locking means sufficiently close to said electric means to be returned to its said retracted position upon restoration of power within said predetermined period.

* * * * *